US009237804B1

(12) United States Patent
Chen et al.

(10) Patent No.: US 9,237,804 B1
(45) Date of Patent: Jan. 19, 2016

(54) DRAWER SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Chien-Hung Kuo, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/314,103

(22) Filed: Jun. 25, 2014

(51) Int. Cl.
*A47B 88/00* (2006.01)
*A47B 88/08* (2006.01)

(52) U.S. Cl.
CPC ..... *A47B 88/08* (2013.01)

(58) Field of Classification Search
CPC .... A47B 88/04; A47B 88/0418; A47B 88/08; A47B 2088/04
USPC ..... 312/334.4, 334.5
See application file for complete search history.

(56) References Cited

U.S. PATENT DOCUMENTS

| | | | | |
|---|---|---|---|---|
| 2,698,214 | A * | 12/1954 | Skamser | 312/334.5 |
| 4,842,422 | A * | 6/1989 | Nelson | 384/19 |
| 6,923,518 | B2 | 8/2005 | Kim | |
| 8,162,420 | B2 * | 4/2012 | Chen et al. | 312/348.4 |
| 2004/0145286 | A1 * | 7/2004 | Kim | 312/334.4 |
| 2005/0162052 | A1 * | 7/2005 | Chen et al. | 312/334.5 |
| 2008/0018213 | A1 | 1/2008 | Chen et al. | |
| 2009/0019667 | A1 * | 1/2009 | Lautenschlager | 16/242 |
| 2012/0321230 | A1 * | 12/2012 | Chen et al. | 384/41 |

* cited by examiner

*Primary Examiner* — Daniel Rohrhoff
(74) *Attorney, Agent, or Firm* — Rosenberg, Klein & Lee

(57) ABSTRACT

A drawer slide rail assembly includes movably connected first and second rails, a movable member, a supporting member, and an adjusting member. The movable member has a mounting hole corresponding to a mounting portion of the second rail and is linearly movably mounted to the second rail via the supporting member. The adjusting member includes a cam with an eccentric shaft. The cam at least partially presses against the movable member. The shaft extends through the movable member and is connected to the second rail. The second rail can be mounted to a drawer via a connector which also connects the movable member and the second rail. The drawer is adjustable in position relative to the second rail by the adjusting member.

7 Claims, 9 Drawing Sheets

DRAWER SLIDE RAIL ASSEMBLY

FIELD OF THE INVENTION

The present invention relates to a drawer slide rail assembly which includes a drawer adjusting mechanism to facilitate the adjustment of the relative position of a drawer mounted to the drawer slide rail assembly.

BACKGROUND OF THE INVENTION

Structures of drawer height adjusting devices are disclosed, for example, in U.S. Pat. No. 6,923,518 B2, granted to Kim; US Patent Application Publication No. 2008/0018213 A1 of Chen et al.; and U.S. Pat. No. 4,842,422, granted to Nelson.

In the prior art disclosed in the patent granted to Kim and the patent application of Chen et al., a drawer is connected to one end of an adjusting element (adjustment member 57, adjusting lever 2) configured for and pivotally connected to a rail, and the vertical position of the drawer can be adjusted by rotating the adjusting element. However, as the drawer is adjusted along a curved path of rotation of the adjusting element, forward or backward displacement of the drawer takes place, too. In the prior art disclosed in the patent granted to Nelson, a drawer can be changed in position relative to a slide rail by directly moving an adjusting element (clamp 327), and yet the operation required is inconvenient.

SUMMARY OF THE INVENTION

The present invention relates to a drawer slide rail assembly which allows a drawer mounted thereto to be easily adjusted in position relative to the drawer slide rail assembly.

According to one aspect of the present invention, a drawer slide rail assembly includes a first rail, a second rail, a movable member, a supporting member, and an adjusting member. The second rail is movably connected to the first rail and includes a pair of sidewalls and a main wall extending between the sidewalls. The main wall includes a mounting portion and a first connecting portion. The movable member is movably mounted on the main wall of the second rail and has a mounting hole, a first hole, and a second hole. The mounting hole corresponds to the mounting portion of the second rail. The first hole corresponds to the first connecting portion of the second rail. The first hole has two lateral sides and defines a width as the distance between the two lateral sides. The first hole further has a top side and a bottom side and defines a height as the distance between the top side and the bottom side. The second hole has a hole wall. At least a portion of the supporting member passes through the first hole of the movable member, is connected to the first connecting portion of the second rail, and has a width and a height. The adjusting member includes a cam and a shaft eccentrically connected to the cam. At least a portion of the cam presses against the hole wall of the second hole of the movable member. The shaft passes through the second hole of the movable member and is connected to the second rail. The width of the supporting member is generally equal to the width of the first hole of the movable member. The height of the supporting member is less than the height of the first hole of the movable member. When the adjusting member is rotated, the movable member is pushed by the cam and is thereby displaced upward or downward relative to the supporting member.

Preferably, the main wall of the second rail has a first projection and a second projection, and the movable member is linearly displaceable relative to the second rail under the guidance of the first projection and the second projection of the second rail.

Preferably, the mounting portion of the second rail is in the form of a hole.

Preferably, the movable member has a first part and a second part extending from and at an angle to the first part, and the second part has a portion movably located in the mounting portion of the second rail.

Preferably, the cam of the adjusting member has an engaging groove in which a tool (e.g., a screwdriver) can be inserted to facilitate rotation of the adjusting member.

Preferably, the drawer slide rail assembly further includes a drawer, and the second rail is mounted to a side of the drawer by a connector, wherein the connector has a portion passing through the mounting hole of the movable member and the mounting portion of the second rail.

According to another aspect of the present invention, a drawer slide rail assembly includes a first rail, a second rail, a movable member, a pair of supporting members, and an adjusting member. The second rail is movably connected to the first rail and includes a pair of sidewalls and a main wall extending between the sidewalls. The movable member has a pair of slots, wherein each of the slots is so oriented as to be generally perpendicular to either of the sidewalls of the second rail. The adjusting member includes a cam and a shaft eccentrically connected to the cam. At least a portion of the cam presses against the movable member. The shaft passes through the movable member and is connected to the second rail. Each of the slots of the movable member is configured for movably connecting with one of the supporting members so that the movable member can be adjusted relative to the supporting members, and hence displaced upward or downward relative to the second rail, via the adjusting member.

According to yet another aspect of the present invention, a drawer slide rail assembly includes a first rail, a second rail, a movable member, a pair of supporting members, and an adjusting member. The second rail is movably connected to the first rail and includes a pair of sidewalls and a main wall extending between the sidewalls. The movable member has a slot, wherein the slot is so oriented as to be generally perpendicular to either of the sidewalls of the second rail. The adjusting member includes a cam and a shaft eccentrically connected to the cam. At least a portion of the cam presses against the movable member. The shaft passes through the movable member and is connected to the second rail. The slot of the movable member is configured for movably connecting with the supporting members so that the movable member can be adjusted relative to the supporting members, and hence displaced upward or downward relative to the second rail, via the adjusting member.

BRIEF DESCRIPTION OF THE DRAWINGS

The invention as well as preferred modes of use and the advantages thereof will be best understood by referring to the following detailed description of some illustrative embodiments in conjunction with the accompanying drawings, in which.

DETAILED DESCRIPTION OF THE INVENTION

Figure 1:
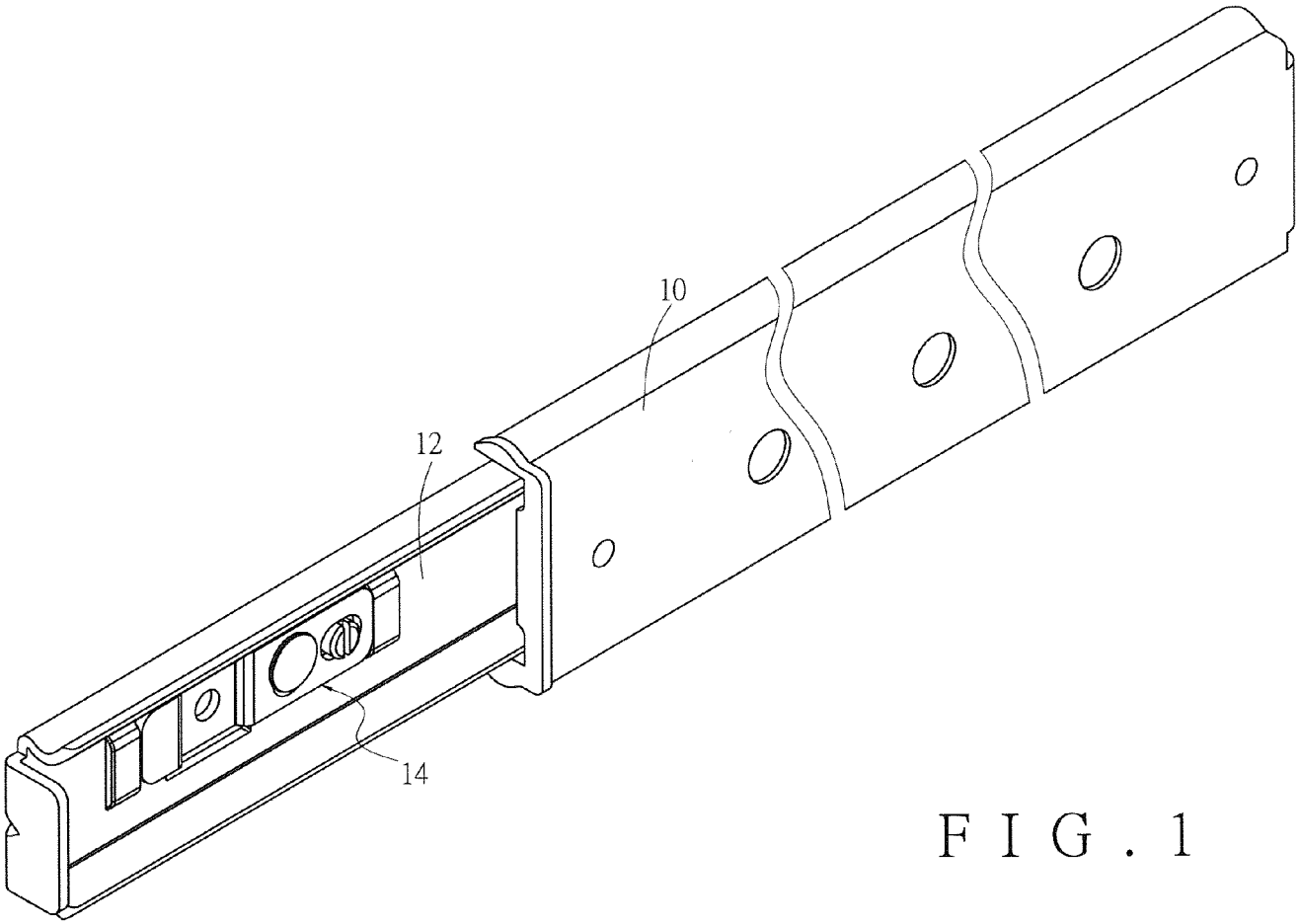
FIG. 1 schematically shows the drawer slide rail assembly in a preferred embodiment of the present invention.

Referring to FIG. 1, the drawer slide rail assembly in the first embodiment of the present invention include a first rail 10, a second rail 12 movably connected to the first rail 10, and a drawer adjusting mechanism 14. The first rail 10 is configured to be mounted to a cabinet (not shown), and the second rail 12 is configured to be mounted to a drawer (not shown). The drawer adjusting mechanism 14 is configured for adjusting the drawer and keeping it in a predetermined horizontal position relative to the first rail 10 so that the drawer can be pulled out of or pushed back into the cabinet smoothly.

Figure 2:
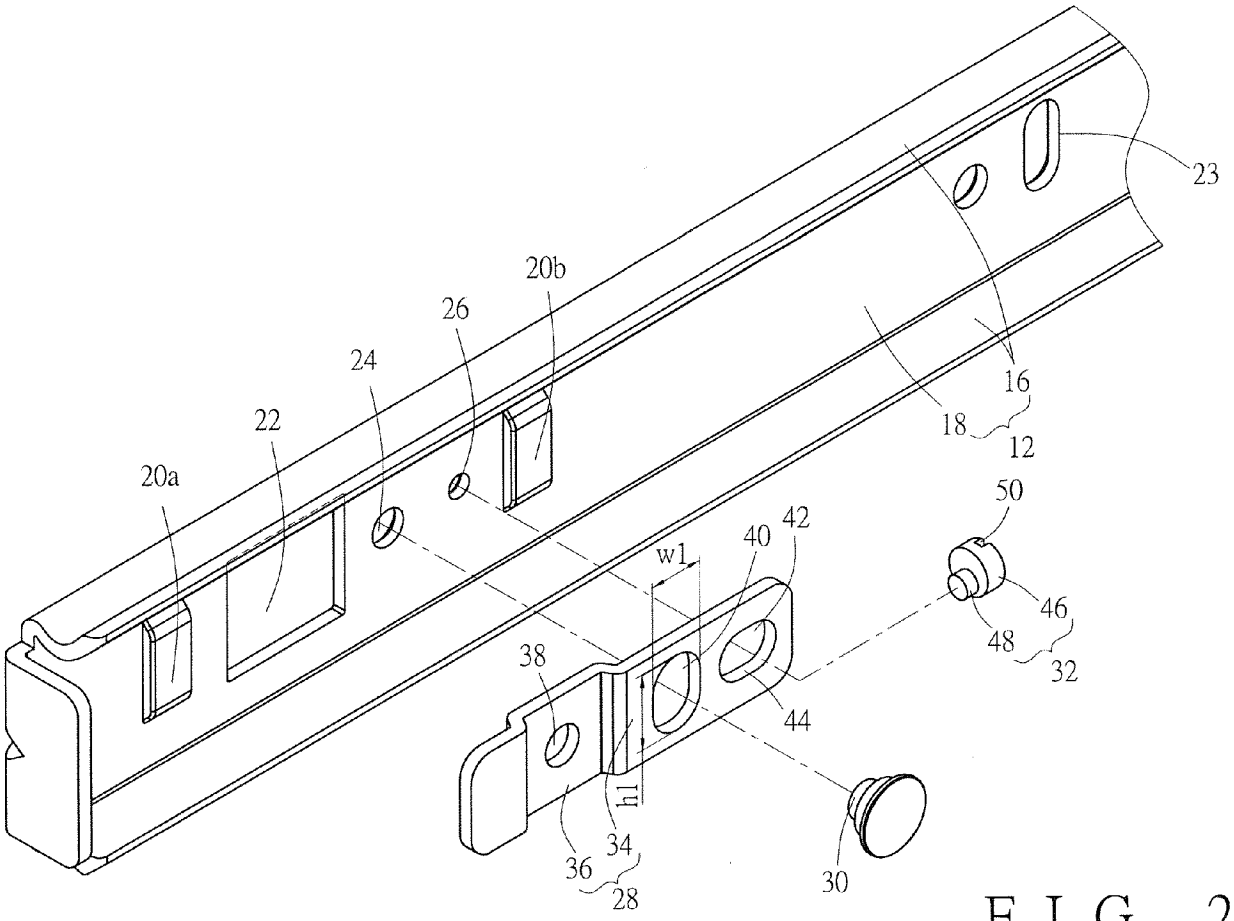
FIG. 2 is an exploded view showing how the drawer adjusting mechanism in a preferred embodiment of the present invention is mounted to a second rail.

As shown in FIG. 2, the second rail 12 has a generally C-shaped cross-section and includes a pair of sidewalls 16 and a main wall 18 extending between the sidewalls 16. The main wall 18 includes a first projection 20*a*, a second projection 20*b*, a mounting portion 22, a first connecting portion 24, and a second connecting portion 26. The mounting portion 22, the first connecting portion 24, and the second connecting portion 26 are located between the first projection 20*a* and the second projection 20*b*. In this embodiment, the mounting portion 22, the first connecting portion 24, and the second connecting portion 26 are all provided in the form of a hole, but these three portions are by no means limited to this form. In a preferred embodiment, the second rail 12 has another mounting portion 23, such as a slot spaced from the mounting portion 22 by a predetermined distance. The mounting portion 22 is adjacent to an end of the main wall 18 of the second rail 12.

Figure 3A:
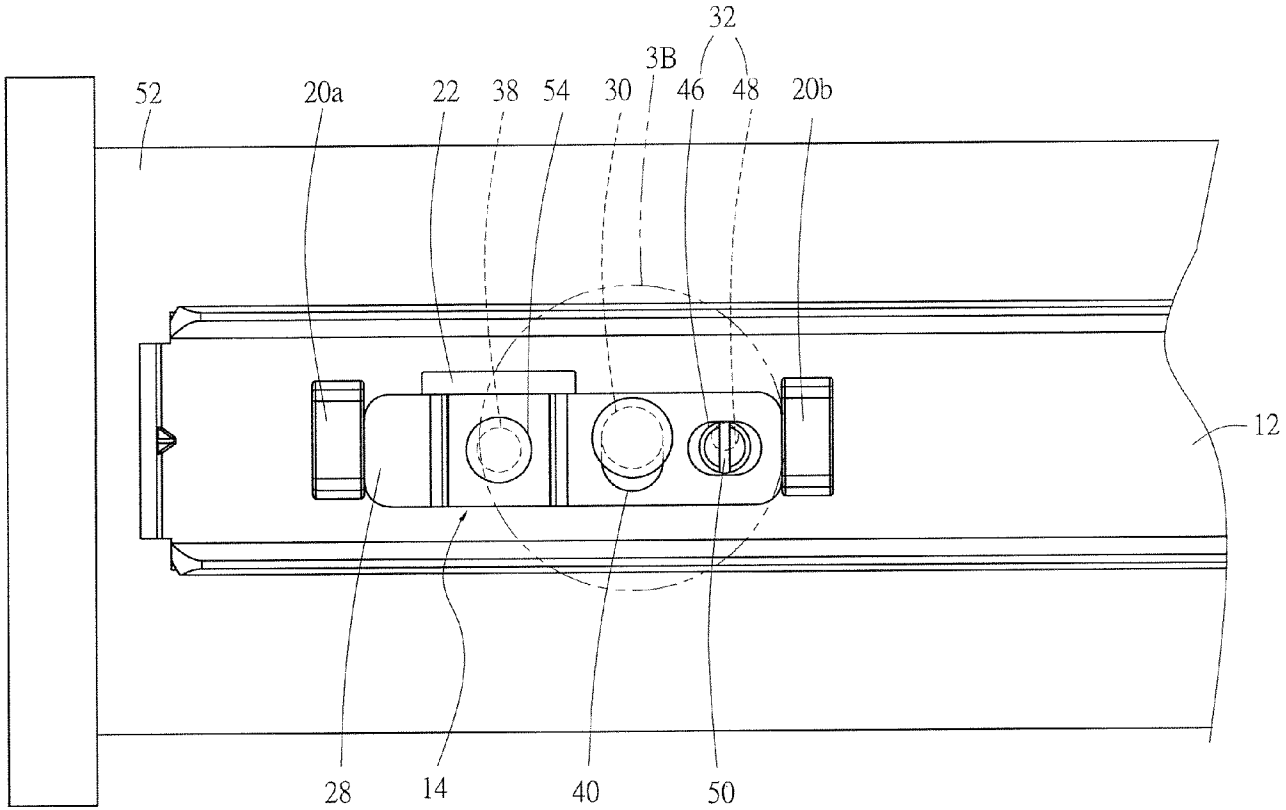
FIG. 3A schematically shows how the drawer slide rail assembly in a preferred embodiment of the present invention is mounted to a side of a drawer.

As shown in FIG. 3A, the drawer adjusting mechanism 14 is mounted on the main wall 18 of the second rail 12. The drawer adjusting mechanism 14 includes a movable member 28, a supporting member 30, and an adjusting member 32.

The movable member 28 is linearly movably mounted on the main wall 18 of the second rail 12 and is located between the first projection 20*a* and the second projection 20*b* of the second rail 12. The first projection 20*a* and the second projection 20*b* of the second rail 12 serve to guide and thereby enable the movable member 28 to displace linearly relative to the second rail 12. More specifically, the movable member 28 has a first part 34, a second part 36 extending from and at an angle to the first part 34, a mounting hole 38, a first hole 40, and a second hole 42. Preferably, a portion of the second part 36 is movably located in the mounting portion 22 of the second rail 12 and can therefore be displaced to a limited extent within the mounting portion 22. The mounting hole 38 is located in the second part 36 and corresponds to the mounting portion 22 of the second rail 12. The first hole 40 and the second hole 42 are located in the first part 34 and correspond to the first connecting portion 24 and the second connecting portion 26 of the second rail 12 respectively. The distance between the two lateral sides of the first hole 40 is defined as width w1, and the distance between the top side and the bottom side of the first hole 40 is defined as height h1. The second hole 42 has a hole wall 44.

Figure 3B:
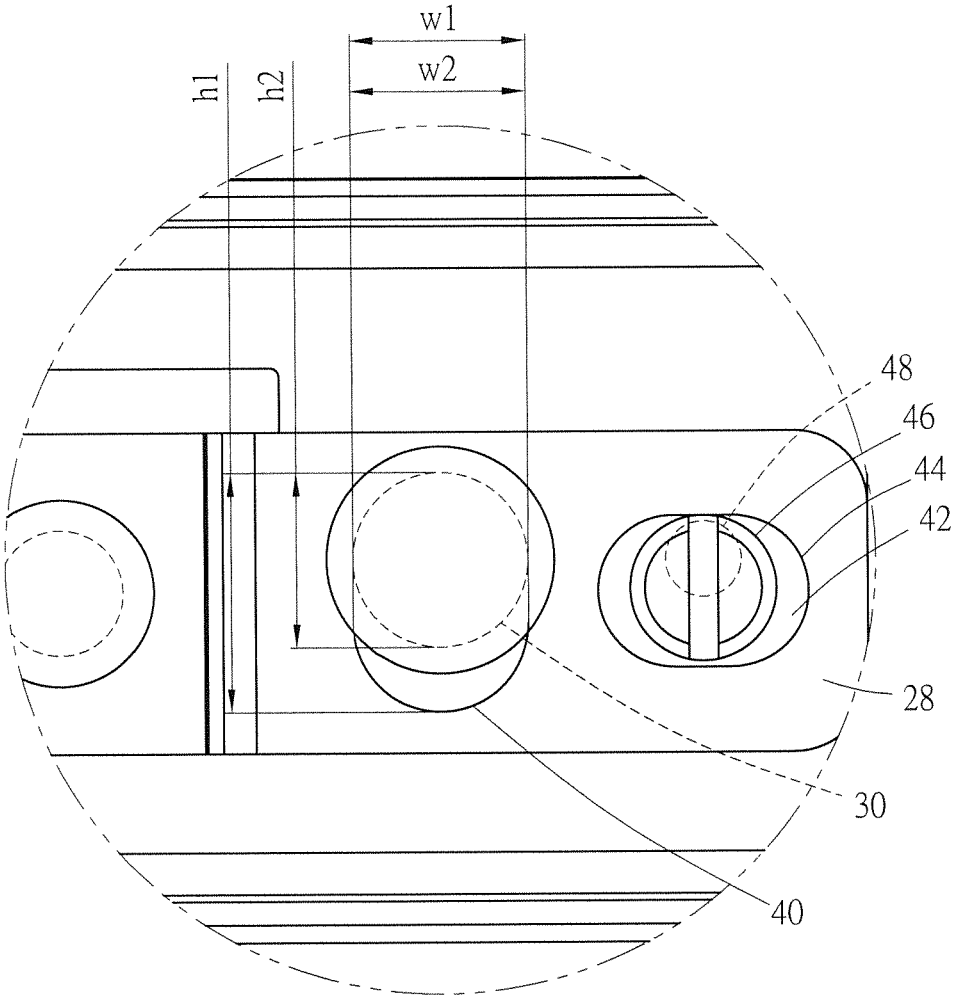
FIG. 3B is an enlarged view of the circled area 3B in FIG. 3A.

At least a portion of the supporting member 30 extends through the first hole 40 of the movable member 28 and is connected to the first connecting portion 24 of the second rail 12. Thus, the supporting member 30 connects the movable member 28 to the second rail 12. More specifically, the at least a portion of the supporting member 30 has a width w2 and a height h2, as shown in FIG. 3B. The width w2 is generally equal to the width w1, but the height h2 is less than the height h1; consequently, a path is formed, allowing the movable member 28 to displace linearly along the path relative to the supporting member 30.

The adjusting member 32 includes a cam 46 and a shaft 48 eccentrically connected to the cam 46. At least a portion of the cam 46 presses against the hole wall 44 of the second hole 42 of the movable member 28. The shaft 48 passes through the second hole 42 of the movable member 28 and is connected to the second connecting portion 26 of the second rail 12. When the adjusting member 32 is rotated, the movable member 28 is pushed by the cam 46 and is hence displaced upward or downward relative to the supporting member 30. Preferably, the cam 46 has a tool portion 50, such as an engaging groove in which a corresponding tool (e.g., a screwdriver) can be inserted to facilitate rotation of the adjusting member 32.

Figure 4:
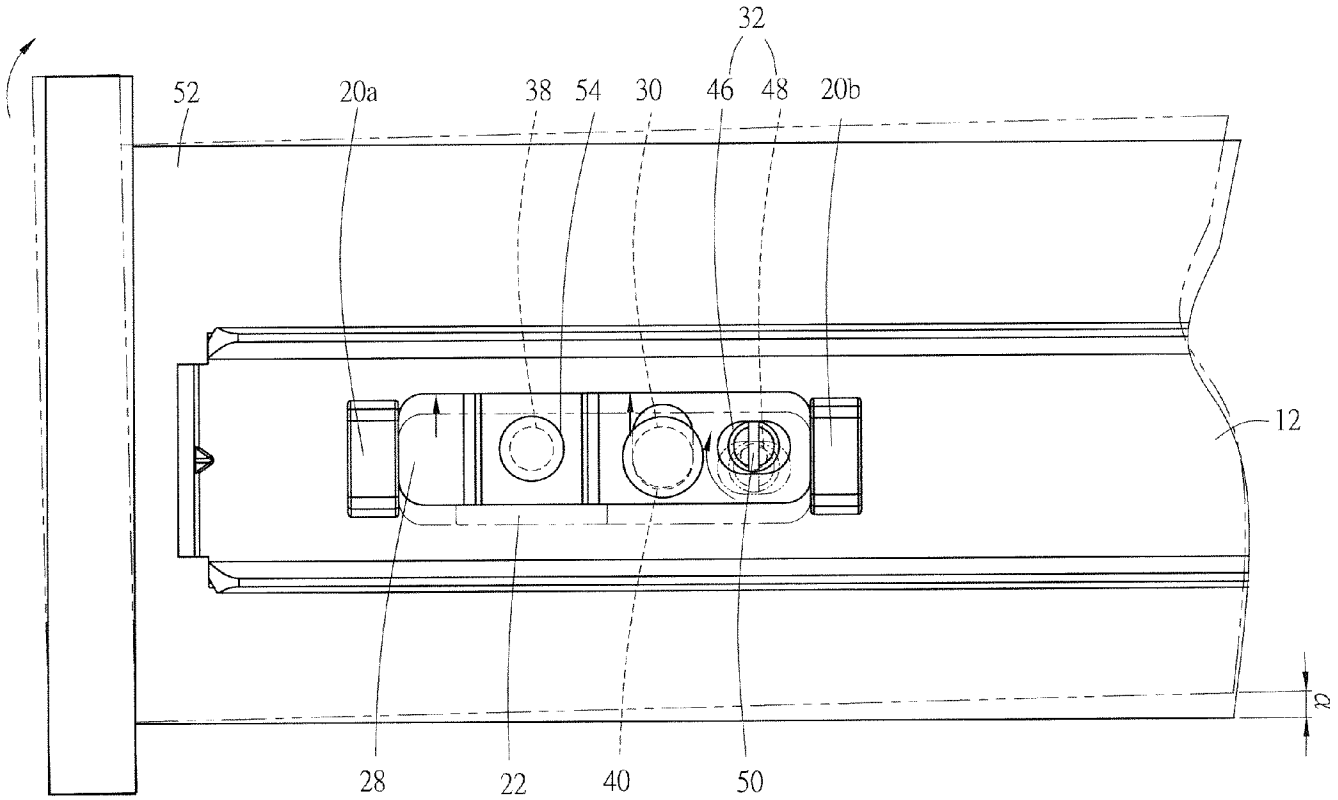
FIG. 4 schematically shows how the drawer is displaced by an angle relative to the second rail in an embodiment of the present invention.

In FIG. 4, the second rail 12 has been mounted to a side of a drawer 52. More specifically, the second rail 12 is mounted to the drawer 52 by a connector 54 a portion of which extends through the mounting hole 38 of the movable member 28 and the mounting portion 22 of the second rail 12. In addition, the mounting portion 23 (see FIG. 2) of the second rail 12 is connected to the drawer 52 by a fixing element (not shown). Therefore, should an inclination angle $\alpha$ be formed between the second rail 12 and the drawer 52 after assembly, the adjusting member 32 can be rotated with a tool to displace the movable member 28 linearly relative to the second rail 12, thereby eliminating the undesirable angle between the second rail 12 and the drawer 52, allowing the drawer 52 to by pulled out of or pushed back into a cabinet in a smooth manner. The foregoing design is particularly useful when a plurality of drawers 52 are vertically arranged in a cabinet, for the gap or angle between each two adjacent drawers 52 can be fine-tuned and corrected as needed.

Figure 5:
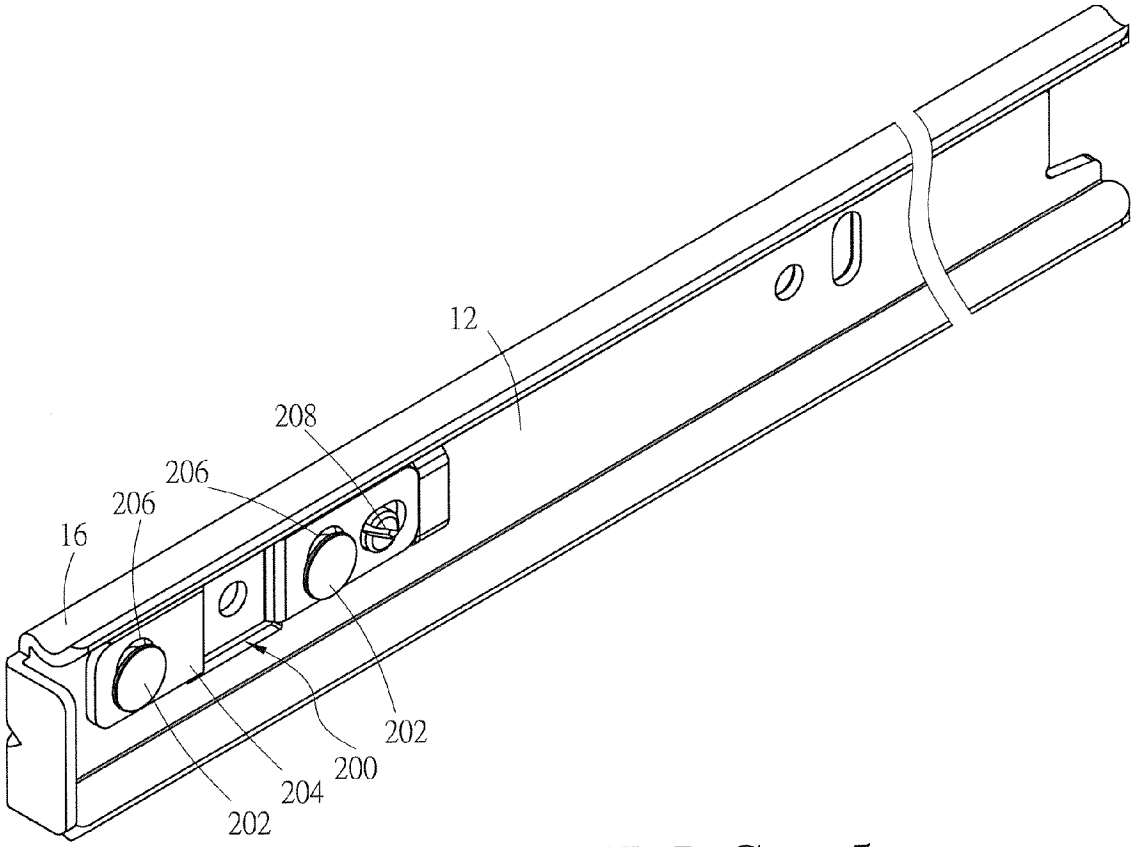
FIG. 5 is a perspective view showing how the drawer adjusting mechanism in a second embodiment of the present invention is mounted to the second rail.
Figure 6:
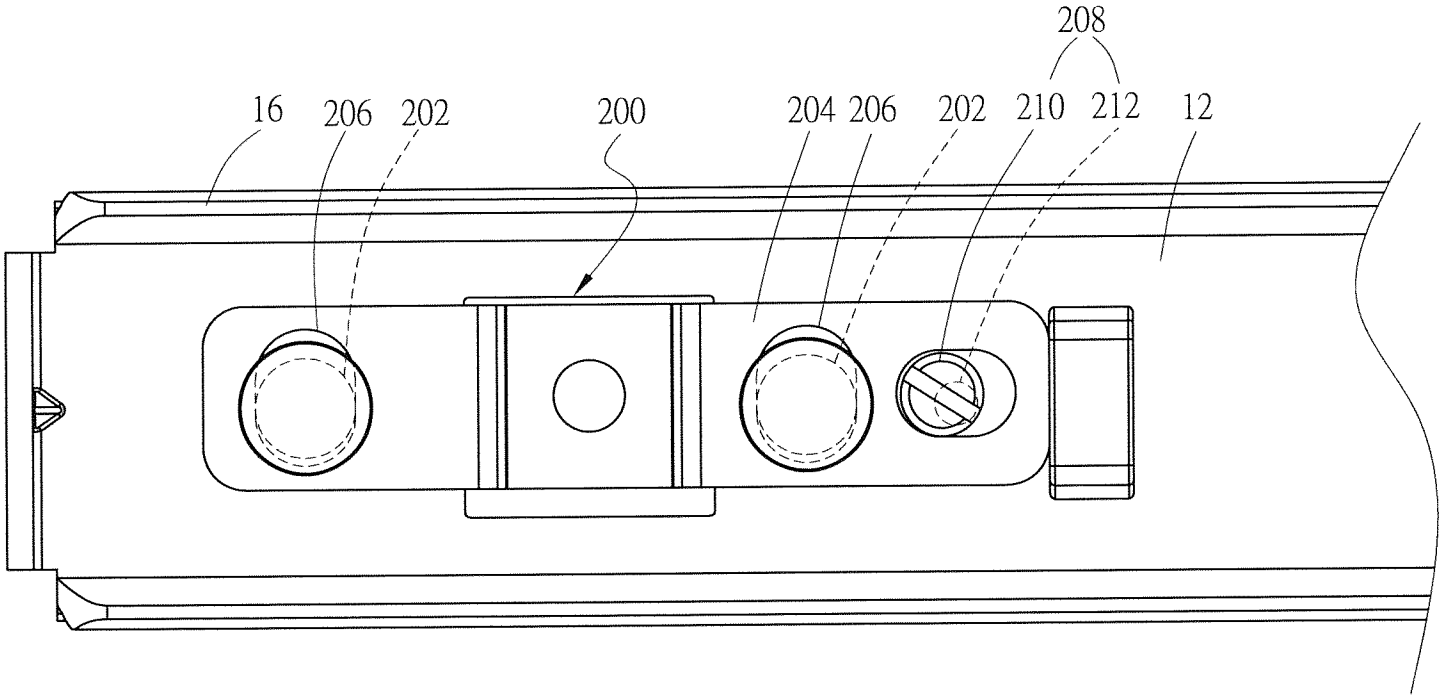
FIG. 6 is a plan view showing how the drawer adjusting mechanism in the second embodiment of the present invention is mounted to the second rail.

FIG. 5 and FIG. 6 show the drawer adjusting mechanism 200 in the second embodiment of the present invention, wherein the drawer adjusting mechanism 200 includes a pair of supporting members 202 connecting a movable member 204 to the second rail 12. In more detail, the movable member 204 has a pair of slots 206 each configured for movably connecting with one supporting member 202. Moreover, each slot 206 is so oriented as to be generally perpendicular to either sidewall 16 of the second rail 12. The drawer adjusting mechanism 200 further includes an adjusting member 208, and the adjusting member 208 includes a cam 210 and a shaft 212 eccentrically connected to the cam 210. At least a portion of the cam 210 presses against the movable member 204, and the shaft 212 passes through the movable member 204 and is connected to the second rail 12 so that, by means of the adjusting member 208, the movable member 204 can be adjusted relative to the supporting members 202 and thus be displaced upward or downward relative to the second rail 12 conveniently.

Figure 7:
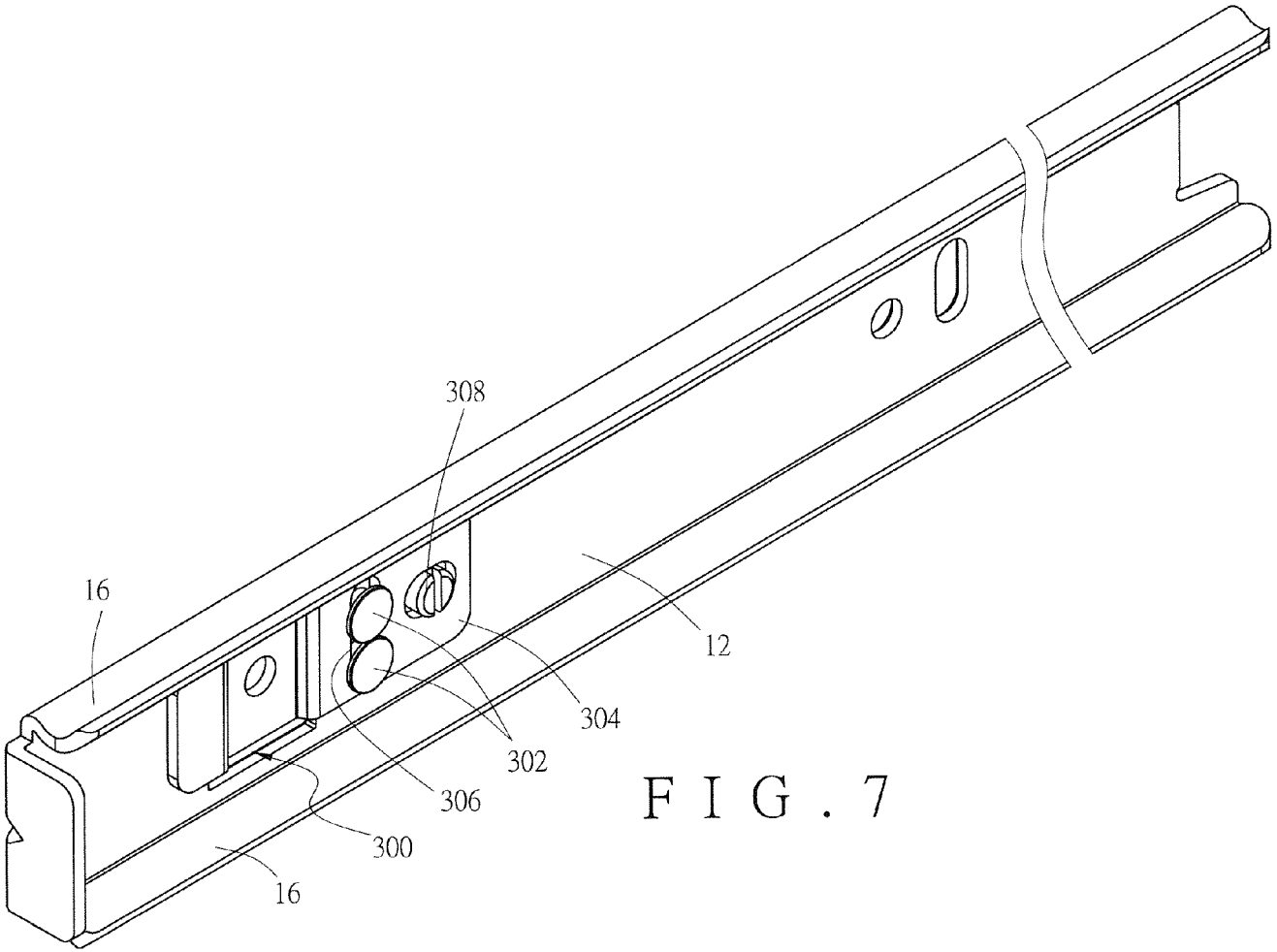
FIG. 7 is a perspective view showing how the drawer adjusting mechanism in a third embodiment of the present invention is mounted to the second rail.
Figure 8:
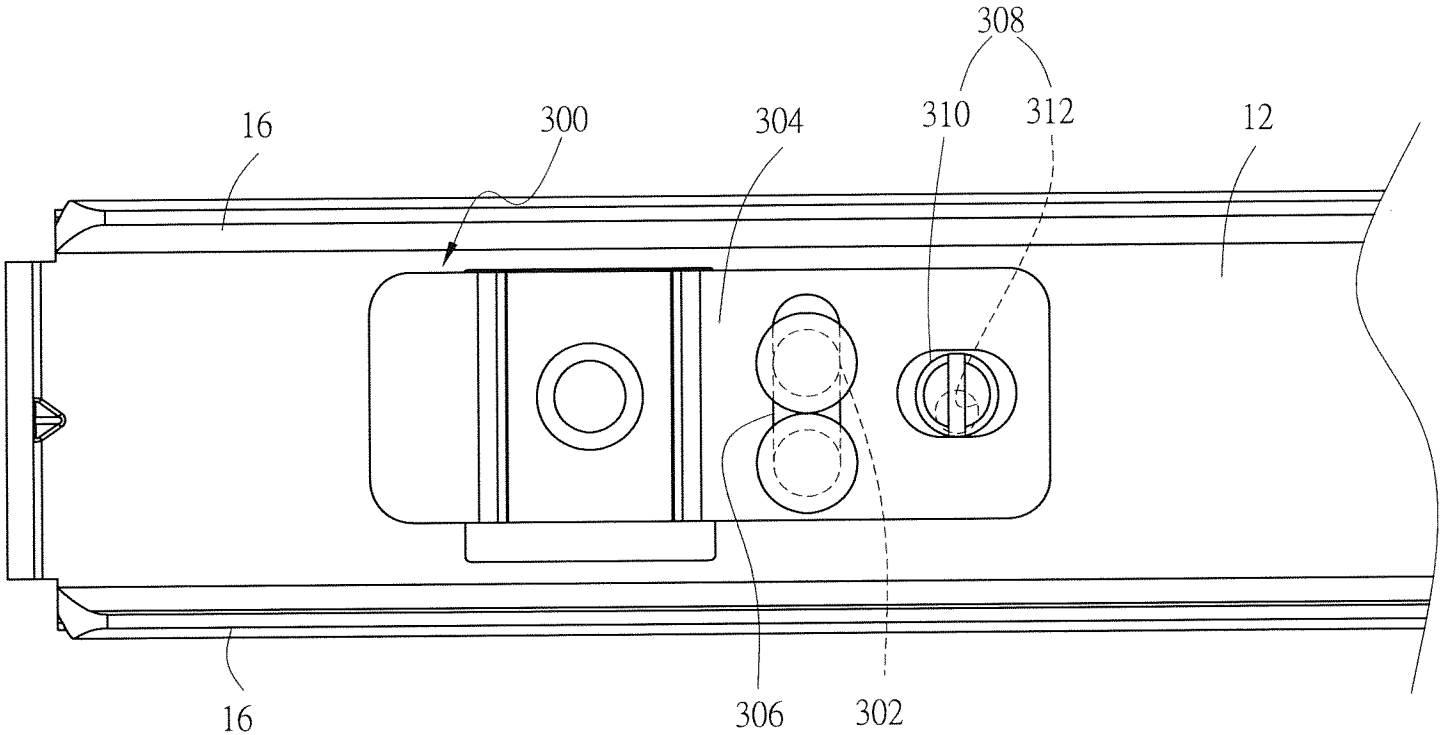
FIG. 8 is a plan view showing how the drawer adjusting mechanism in the third embodiment of the present invention is mounted to the second rail.

FIG. 7 and FIG. 8 show the drawer adjusting mechanism 300 in the third embodiment of the present invention, wherein the drawer adjusting mechanism 300 includes a pair of supporting members 302 connecting a movable member 304 to the second rail 12. More specifically, the movable member 304 has a slot 306 for movably connecting with the supporting members 302. The slot 306 is so oriented as to be generally perpendicular to either sidewall 16 of the second rail 12. The drawer adjusting mechanism 300 further includes an adjusting member 308, and the adjusting member 308 includes a cam 310 and a shaft 312 eccentrically connected to the cam 310. At least a portion of the cam 310 presses against the movable member 304, and the shaft 312 passes through the movable member 304 and is connected to the second rail 12 so that, by means of the adjusting member 308, the movable member 304 can be adjusted relative to the supporting members 302 and thus be displaced upward or downward relative to the second rail 12 conveniently.

While the present invention has been disclosed through the foregoing preferred embodiments, the embodiments are not intended to be restrictive of the present invention. The scope of patent protection sought by the applicant is defined by the appended claims.

The invention claimed is:

1. A drawer slide rail assembly, comprising:

a first rail;

a second rail movably connected to the first rail, the second rail comprising a pair of sidewalls and a main wall extending between the sidewalls, the main wall comprising a mounting portion;

a movable member movably mounted on the main wall of the second rail, the movable member having a mounting hole, a first hole, and a second hole, wherein the mounting hole corresponds to the mounting portion of the second rail, the first hole has two lateral sides and defines a width as a distance between the two lateral sides, the first hole further has a top side and a bottom side and defines a height as a distance between the top side and the bottom side, and the second hole has a hole wall;

a supporting member, at least a portion of which passes through the first hole of the movable member, is connected to the second rail, and has a width and a height; and an adjusting member comprising a cam and a shaft eccentrically connected to the cam, wherein at least a portion of the cam presses against the hole wall of the second hole of the movable member, and the shaft passes through the second hole of the movable member and is connected to the second rail;

wherein the width of the supporting member is generally equal to the width of the first hole of the movable member, and the height of the supporting member is less than the height of the first hole of the movable member such that, when the adjusting member is rotated, the movable member is pushed by the cam and is thereby displaced upward or downward relative to the supporting member; and the main wall of the second rail has a first projection and a second projection, and the movable member is linearly displaceable relative to the second rail under guidance of the first projection and the second projection of the second rail.

2. The drawer slide rail assembly of claim 1, wherein the mounting portion of the second rail is a hole.

3. The drawer slide rail assembly of claim 2, wherein the movable member has a first part and a second part extending from and at an angle to the first part, and the second part has a portion movably located in the mounting portion of the second rail.

4. The drawer slide rail assembly of claim 1, wherein the cam of the adjusting member has an engaging groove in which a tool can be inserted to facilitate rotation of the adjusting member.

5. The drawer slide rail assembly of claim 1, further comprising a drawer, wherein the second rail is mounted to a side of the drawer by a connector having a portion passing through the mounting hole of the movable member and the mounting portion of the second rail.

6. A drawer slide rail assembly, comprising:

a first rail;

a second rail movably connected to the first rail, the second rail comprising a pair of sidewalls and a main wall extending between the sidewalls;

a movable member having a pair of slots, each of the slots being so oriented as to be generally perpendicular to either of the sidewalls of the second rail;

a pair of supporting members; and an adjusting member comprising a cam and a shaft eccentrically connected to the cam, wherein at least a portion of the cam presses against the movable member, and the shaft passes through the movable member and is connected to the second rail;

wherein each of the slots of the movable member is configured for movably connecting with one of the supporting members so that the movable member is adjustable relative to the supporting members, and hence upwardly or downwardly displaceable relative to the second rail, via the adjusting member.

7. A drawer slide rail assembly, comprising:

a first rail;

a second rail movably connected to the first rail, the second rail comprising a pair of sidewalls and a main wall extending between the sidewalls;

a movable member having a slot, the slot being so oriented as to be generally perpendicular to either of the sidewalls of the second rail;

a pair of supporting members; and an adjusting member comprising a cam and a shaft eccentrically connected to the cam, wherein at least a portion of the cam presses against the movable member, and the shaft passes through the movable member and is connected to the second rail;

wherein the slot of the movable member is configured for movably connecting with the supporting members so that the movable member is adjustable relative to the supporting members, and hence upwardly or downwardly displaceable relative to the second rail, via the adjusting member.

* * * * *